US006082457A

United States Patent [19]

Best et al.

[11] Patent Number: 6,082,457

[45] Date of Patent: Jul. 4, 2000

[54] METHOD OF USING A DRILL STRING TOOL

[75] Inventors: Bruno Best; Markus Antonius Van Buren, both of Rijswijk, Netherlands

[73] Assignee: Shell Oil Company, Houston, Tex.

[21] Appl. No.: 09/030,310

[22] Filed: Feb. 25, 1998

[30] Foreign Application Priority Data

Feb. 25, 1997 [EP] European Pat. Off. ..... 97200538

[51] Int. Cl.[7] ..... E21B 23/00; E21B 31/00

[52] U.S. Cl. ..... 166/301; 464/18; 175/106; 175/306; 166/178; 166/312

[58] Field of Search ..... 175/101, 106, 175/305, 306, 320, 321, 316, 237; 464/18, 20, 30, 162, 163; 166/301, 178, 312, 384, 117.7

[56] References Cited

U.S. PATENT DOCUMENTS

| | | | |
|---|---|---|---|
| 4,573,536 | 3/1986 | Lawrence | 166/373 |
| 4,576,229 | 3/1986 | Brown | 166/177 |
| 4,728,124 | 3/1988 | Righi et al. | 285/2 |
| 4,890,682 | 1/1990 | Worrall et al. | 175/61 |
| 4,958,691 | 9/1990 | Hipp | 175/296 |
| 5,431,221 | 7/1995 | Roberts et al. | 166/73 |
| 5,669,455 | 9/1997 | Dietrich | 175/57 |
| 5,857,710 | 1/1999 | Leising et al. | 285/3 |

*Primary Examiner*—David Bagnell
*Assistant Examiner*—Jennifer R Dougherty

[57] ABSTRACT

A method of operating a drill string tool for use in a wellbore formed in an earth formation is provided. T he method comprises rotating an upper drill string part while a rotation transfer assembly transfers the rotation of a first element to a second element so as to rotate a lower drill string part in order to drill a section of a wellbore, inducing a controller to disengage the rotation transfer assembly so as to allow the first element to rotate relative to the second element by virtue of bearings, and rotating the upper drill string part about its longitudinal axis while the lower drill string part remains substantially stationary.

6 Claims, 1 Drawing Sheet

METHOD OF USING A DRILL STRING TOOL

FIELD OF THE INVENTION

The present invention relates to a drill string tool for use in a drill string extending in a wellbore formed in an earth formation.

BACKGROUND OF THE INVENTION

Wellbores which are drilled in the earth formation for hydrocarbon exploration and production purposes become ever deeper and more complex in geometry as many times curved, inclined or horizontal sections are included. Such deep and complex wellbores impose stringent requirements on the drill strings used. However an unresolved problem is the occurrence of large friction forces between the drill string and the wellbore wall, which friction forces often hamper adequate wellbore operations.

For example it frequently occurs that the lower drill string part, generally referred to as the bottom hole assembly (BHA), becomes stuck in the wellbore. To release the stuck part of the drill string, a tensile- or compressive force is applied to the upper drill string part to free the stuck lower drill string part. To increase the effect of such force, a jarring tool is generally incorporated in the drill string at a location above the part of the drill string which is suspected to become stuck in the wellbore. Such jarring tool includes, for example, telescoping upper and lower parts, the upper part being connected to the upper drill string part and the lower part being connected to the lower drill string part. Upon applying a tensile- or compressive force to the upper drill string part, the upper telescoping part is initially subjected to a high resistance against upward or downward movement (for example by means of a narrow flow restriction for hydraulic oil) and thereafter suddenly to a low resistance against such movement until a stop prevents further movement. As a result, elastic energy which has initially accumulated in the upper drill string part is suddenly released and causes an impact force on the lower drill string part.

A problem of the conventional method of releasing a drill string is the occurrence of large longitudinal friction forces between the drill string and the wellbore wall, which friction forces significantly reduce the effective tensile- or compressive force at the stuck part of the drill string. Especially in highly deviated wellbores a large part of the tensile- or compressive force is counter-acted by longitudinal friction forces. Furthermore, the friction forces increase with increasing length of the drill string, so that for deeper wellbores it will be more difficult to free the drill string.

Furthermore, in wellbore drilling it is frequently required to clean the wellbore by removing drill cuttings from the wellbore using a stream of drilling fluid. However, a significant part of the drill cuttings sometimes cannot be efficiently removed.

It is an object of the present invention to provide a drill string tool and a method for significantly reducing the longitudinal friction forces imposed by the wellbore on the drill string.

It is another object of the invention to provide a drill string tool and a method for enhanced wellbore cleaning.

SUMMARY OF THE INVENTION

In accordance with one aspect of the invention there is provided a drill string tool for use in a wellbore formed in an earth formation, the tool comprising a first element connectable to an upper drill string part, a second element connectable to a lower drill string part, bearing means allowing rotation of the first element relative to the second element about the longitudinal axis of the drill string, rotation transfer means for transferring rotation of the first element about the longitudinal axis to the second element, and control means for selectively disengaging said rotation transfer means so as to selectively allow the first element to rotate relative to the second element by virtue of said bearing means.

The method of operating the drill string tool according to the invention, wherein the first element is connected to the upper drill string part extending in said wellbore and the second element is connected to the lower drill string part extending in the wellbore, comprises the steps of:

a) rotating the upper drill string part while the rotation transfer means transfers the rotation of the first element to the second element so as to rotate the lower drill string part in order to drill a section of said wellbore;

b) inducing the control means to disengage the rotation transfer means so as to allow the first element to rotate relative to the second element by virtue of the bearing means; and c) rotating the upper drill string part about its longitudinal axis while the lower drill string part remains substantially stationary.

DETAILED DESCRIPTION

Figure 1:
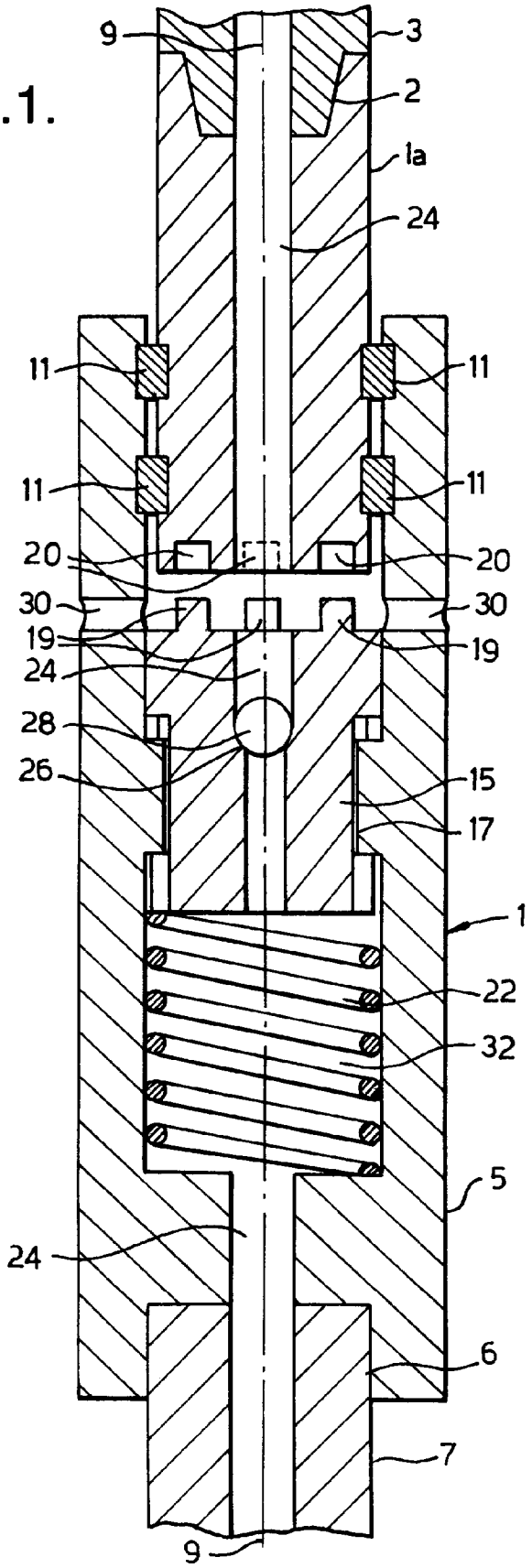
FIG. 1 schematically shows a longitudinal cross-section of the drill string tool according to the invention.

When, for example, the lower drill string part has become stuck in the wellbore, the rotation transfer means is disengaged which allows rotation of the upper drill string part in the wellbore relative to the lower drill string part. Since the direction of the friction forces imposed by the wellbore wall on the drill string is the direction of relative movement, these forces are substantially in circumferential direction of the upper drill string part during rotation thereof. Any additional longitudinal friction force component which may arise as a result of an applied longitudinal force to the string, has a reduced magnitude due to the limited magnitude of the total friction force (as for example defined in Coulomb's friction law). Thus by rotating the upper drill string part while the lower drill string part remains stationary, it is achieved that the longitudinal friction component is significantly reduced. In case of a stuck lower drill string part, virtually the entire applied longitudinal force at surface minus the weight of the string is therefore available downhole for releasing the stuck lower drill string part.

Suitably the drill string tool is applied in case the lower drill string part has become stuck in the wellbore, wherein during step c) a longitudinal force is applied to the upper drill string part so as to release the lower drill string part from the wellbore.

The drill string tool according to the invention can also be applied for the purpose of wellbore cleaning, wherein during or after step c) wellbore fluid flows through the wellbore so as to clean the wellbore from drill cuttings. By rotating the upper drill string part the wellbore fluid which surrounds the drill string is set in motion so that rock particles, such as drill cuttings, move together with the wellbore fluid. Thereby such rock particles can be removed from the wellbore more efficiently, while the drill bit at the lower end of the drill string remains stationary.

In order to enhance the wellbore cleaning efficiency, suitably the rotational speed of the upper drill string part during step c) is selected so as to induce a lateral vibration of the upper drill string part in the wellbore.

More preferably the upper drill string part is induced to take a helical shape in the wellbore during step c). This can be achieved, for example, by allowing the upper drill string part to buckle in a controlled manner. The rotating helical upper drill string part has a pumping effect in the wellbore so that wellbore fluid and particles are pumped out of the wellbore.

The invention will be described hereinafter in more detail and by way of example with reference to the accompanying drawing.

The drill string tool 1 shown in FIG. 1 includes a first element in the form of mandrel 1*a* connected by a connector 2 to an upper drill string part 3, and a second element in the form of housing 5 connected by a connector 6 to a lower drill string part 7. The mandrel 1*a* is rotatable within the housing 5 around the longitudinal axis 9 of the tool by means of bearings 11 located between the mandrel 1*a* and the housing 5, the bearings 11 allowing no other relative movement between the mandrel 1*a* and the housing 5. A clutch 15 is arranged within the housing 5 via a spline arrangement 17 which allows sliding of the clutch 15 within the housing in longitudinal direction thereof between two end positions. The clutch is at its end nearest the mandrel 1*a* provided with teeth 19 which fit into corresponding recesses 20 provided in the mandrel 1*a*. A spring 22 urges the clutch 15 to a first end position whereby the teeth 19 are located in the recesses 20, in which first end position rotational movement of the mandrel 1*a* is transferred via the cooperating recesses 20 and teeth 19, and via the spline arrangement 17, to the housing 5.

A fluid passage 24 for the flow of drilling fluid extends longitudinally through mandrel 1*a*, clutch 15 and housing 5. A seat 26 for an elastomeric activating ball 28 is arranged in the fluid passage 24 within the clutch 15, the seat 26 and the activating ball 28 being so dimensioned that the activating ball 28 plugs the fluid passage 24 within the clutch 15 when located on the seat 26. A plurality of outlet openings 30 is provided in the housing 5, which outlet openings 30 provide fluid communication between the interior and the exterior of the housing 5. The clutch 15 closes the outlet openings 30 when the clutch is in its first end position. The second end position of the clutch 15 is defined by suitable stop means (not shown), in which second end position the spring 22 is more compressed than in the first end position and the outlet openings are not closed by the clutch 15.

The elastomeric ball 28 is so dimensioned that the ball 28 is squeezed through the seat 26 and through the fluid passage 24 in the clutch 15 upon application of a suitable over-pressure in the fluid passage 24 upstream the ball 28. A ball receiver (not shown) which is suitable to receive and retain a plurality of balls 28 is located within a space 32 in the housing 5 where the spring 22 is located.

During normal use of the drill string tool 1 for the purpose of releasing the lower drill string part 7 which is stuck in a wellbore the tool 1 is located in the drill string above or below a jarring tool (not shown) incorporated in the lower drill string part 7, but above the stuck point. The clutch 15 is urged by spring 22 in the first end position which is the normal drilling position. In this position the outlet openings 30 are closed and rotational movement of the mandrel 1*a* is transferred by the clutch 15 to the housing 5. Drilling fluid is pumped through the fluid passage 24 to a drill bit (not shown) at the lower end of the drill string. In order to release the stuck lower drill string part 7 the activating ball 28 is pumped through the drill string to the seat 26 so as to plug the fluid passage 24. The fluid pressure thereby increases (due to continued pumping), and urges the clutch 15 to its second end position. As the clutch 15 moves to its second end position the outlet openings 30 become uncovered so that drilling fluid flows from the passage 24, through the openings 30, to the annular space (not shown) between the drill string and the wellbore.

With the clutch 15 in its second position, the mandrel 1*a* can freely rotate within the housing 5. By rotating the upper drill string part 3 and the mandrel 1*a*, the friction force between the drill string and the wellbore wall is directed circumferentially. In this situation any longitudinal movement imposed on the upper drill string part 3 does not lead to a longitudinal friction force component of substantial magnitude because the magnitude of the total friction force is limited. Thus, a pulling force applied to the upper drill string part 3 is not counter-acted by any significant longitudinal friction force. As a result substantially the whole pulling force is available to accumulate elastic energy in the upper drill string part 3. The jarring tool abruptly releases this accumulated energy so as to create a strong impact force which releases the lower drill string part.

After the drill string has been released from the wellbore a selected over-pressure is applied to the fluid in passage 24 so as to squeeze the ball 28 to the space 32 where the ball 28 is received and retained by the ball receiver. Following the arrival of the ball 28 in space 32 the fluid pressure in the passage 24 decreases again so that spring 22 urges clutch 15 back to its first end position so as to be re-engaged, and drilling can be resumed.

During normal use of the drill string tool 1 for the purpose of wellbore cleaning, the activating ball 28 is pumped through the drill string in order to disengage the clutch 15 and to free the outlet openings 30, as described above. The upper drill string part 3 is then rotated at a speed selected so as to create a lateral vibration thereof while wellbore fluid is circulated through the drill string via outlet openings 30. The vibrating drill string enhances the cleaning efficiency of the circulating wellbore fluid.

Instead of inducing lateral vibration of the upper drill string part for the purpose of wellbore cleaning, the upper drill string part can be induced to take a helical shape during rotation in the wellbore. The rotating helical upper drill string part acts as a pump which pumps wellbore fluid and particles contained therein out of the wellbore.

In an alternative arrangement the second element and the jarring apparatus are integrally formed.

Instead of applying the activating ball arrangement to control the clutch as described above, engagement and disengagement can be achieved by a "J-slot" mechanism. In such mechanism the clutch can be controlled by lowering or raising the upper drill string part and applying a selected amount of rotation thereto. Such "J-slot" mechanism can be applied, for example, in a so-called fishing string, and can be combined with a fluid pressure pulse activating mechanism for engaging/disengaging the clutch.

Alternatively a wireless telemetry system can be applied in combination with a down-hole clutch actuator to control the clutch. For example, in such system a downhole mud-pulse receiver receives a mud pulse signal from surface, which mud pulse signal contains an instruction to engage or to disengage the clutch. The mud pulse signal is encoded by an electronic system which controls a hydraulic system for engaging or disengaging the clutch. The power required to operate the down-hole electronics and hydraulics systems including the actuator can be generated from the mud stream by a turbine/alternator combination commonly used in Measurement While Drilling tools.

What is claimed is:

1. A method of operating a drill string tool for use in a wellbore formed in an earth formation, the tool comprising a first element connectable to an upper drill string part extending in said wellbore, a second element connected to a lower drill string part extending in said wellbore, the lower drill string part being stuck in the wellbore, bearing means allowing rotation of the first element relative to the second element about the longitudinal axis of the drill string, rotation transfer means for transferring rotation of the first element about the longitudinal axis to the second element, and control means for selectively disengaging said rotation transfer means so as to selectively allow the first element to rotate relative to the second element by virtue of said bearing means, the method comprising the steps of:

a) rotating the upper drill string part while the rotation transfer means transfers the rotation of the first clement to the second element so as to rotate the lower drill string part in order to drill a section of said wellbore;

b) inducing the control means to disengage the rotation transfer means so as to allow the first element to rotate relative to the second element by virtue of the bearing means; and c) rotating the upper drill string part about its longitudinal axis while the lower drill string part remains substantially stationary;

wherein during step c) a longitudinal force is applied to the upper drill string part so as to release the lower drill string part from the wellbore.

2. The method of claim 1, wherein during or after step c) wellbore fluid flows through the wellbore so as to clean the wellbore from drill cuttings.

3. The method of claim 1, where the rotational speed of the upper drill string part during step c) is selected so as to induce a lateral vibration of the upper drill string part in the wellbore.

4. A method of operating a drill string tool for use in a wellbore formed in an earth formation, the tool comprising a first element connectable to an upper drill string part extending in said wellbore, a second element connected to a lower drill string part extending, in said wellbore, bearing means allowing rotation of the first element relative to the second element about the longitudinal axis of the drill string, rotation transfer means for transferring rotation of the first element about the longitudinal axis to the second element, and control means for selectively disengaging said rotation transfer means so as to selectively allow the first element to rotate relative to the second element by virtue of said bearing means, the method comprising the steps of:

a) rotating the upper drill string part while the rotation transfer means transfers the rotation of the first element to the second element so as to rotate the lower drill string part in order to drill a section of said wellbore;

b) inducing the control means to disengage the rotation transfer means so as to allow the first element to rotate relative to the second element by virtue of the bearing means; and c) rotating the upper drill string part about its longitudinal axis while the lower drill string part remains substantially stationary;

wherein the upper drill string part is induced to take a helical shape in the wellbore during step c).

5. The method of claim 4, wherein during or after step c) wellbore fluid flows through the wellbore so as to clean the wellbore from drill cuttings.

6. The method of claim 4, wherein the rotational speed of the upper drill string part during step c) is selected so as to induce a lateral vibration of the upper drill string part in the wellbore.

* * * * *